US006095599A

United States Patent [19]

Lambert

[11] Patent Number: 6,095,599

[45] **Date of Patent: *Aug. 1, 2000**

[54] COMBINED CANOE CARRIER AND CHAIR

[76] Inventor: Michael Lambert, 2201 Deschenes Street, Ottawa, Canada, K2B 6N2

[ * ] Notice: This patent is subject to a terminal disclaimer.

[21] Appl. No.: 08/663,940

[22] Filed: Jun. 14, 1996

Related U.S. Application Data

[63] Continuation-in-part of application No. 08/453,280, May 30, 1995, Pat. No. 5,547,246.

[51] Int. Cl.[7] ..... A47C 13/00

[52] U.S. Cl. ..... 297/129; 224/211; 224/262; 224/155; 297/118

[58] Field of Search ..... 297/129, 464, 297/188.01, 118; 224/211, 155, 262, 153

[56] References Cited

U.S. PATENT DOCUMENTS 3,733,017 5/1973 Pletz ..... 224/8 R
3,734,367 5/1973 Jackson ..... 224/25 A
4,676,548 6/1987 Bradbury ..... 297/129
5,303,975 4/1994 Asato ..... 297/129
5,381,941 1/1995 Brune ..... 224/155
5,547,246 8/1996 Lambert ..... 297/129

*Primary Examiner*—Peter M. Cuomo
*Assistant Examiner*—Stephen Vu

[57] ABSTRACT

A combination canoe carrier and camp chair. The carrier supports an inverted canoe on a person's back and is also capable of being converted to a folding camp chair. The chair includes two rectangular frames pivotally connected intermediate their ends. Webbing is secured to the frame to provide seat and back portions and the frames are interconnected by straps to provide a chair configuration. In the canoe carrier mode a web interconnects upper ends of the frames to support the thwart of the inverted canoe. Suitable shoulder straps and a hip belt are also attached to the carrier.

3 Claims, 4 Drawing Sheets

COMBINED CANOE CARRIER AND CHAIR

This a Continuation-in-Part of U.S. application No. 08/453,280 filed May 30, 1995 now U.S. Pat. No. 5,547,246.

BACKGROUND OF THE INVENTION

This invention relates to camping equipment and more particularly to a combined back pack and folding camp chair which is adapted for carrying a canoe.

Carrying a heavy and long canoe any distance over rough ground poses a problem. Canoes, particulary white water canoes, are heavy (typically from 50 to 90 pounds in weight) and from 12 to 18 feet in length. This makes them difficult for one person to lift and carry. Two people may lift a canoe more easily but because of the unevenness of the terrain and obstacles, such as rocks and roots, each tends to walk at differing speeds throwing the other off balance. There is a risk of injury if one person stumbles, throwing the other person off balance. Traditionally, a single person portages the canoe, alone. As a consequence people of lesser strength cannot portage canoes and even those strong enough frequently avoid travel on rivers with long or arduous portages.

A second difficulty with canoe camping is seating at the end of the day. Usually by then a canoeist has tired muscles particularly in their back. Traditionally, canoeists sit on the ground or a log. These can be wet, cold, dirty and hard and provide little or no support for a fatigued back. Some canoeists take folding camping chairs but these add extra weight and are awkward to portage.

A number of back pack and chair combinations have been proposed. However, these pack frames are not particularly suitable for comfortably and safely supporting a canoe. The provision of a practical canoe carrier requires re-dimensioning the chair frame to provide the optimum carrier shape while keeping in mind that a usable chair is also desirable.

The prior combination pack frames and chair do not appear to have any means f or engaging cross members of an inverted canoe.

Transporting a canoe by an individual has been tradition ally accomplished by balancing a centrally located thwart of the canoe or a yoke on the person's shoulders, and thus the weight of the canoe rests heavily on the neck and shoulders.

An example of a prior attempt at providing a canoe carrier on a pack frame is shown in U.S. Pat. No. 3,734,367. However, no attempt has been made to use the pack frame and another frame member to provide a camp chair.

The present invention seeks to overcome these problems by the provision of a carrier to redistribute the weight from the shoulders to the waist and hips alleviating pressure points and arm and back strain while improving the balance and allowing free use of at least one hand.

The present invention further seeks to provide a carrier on which a canoe can be readily positioned by the individual.

The present invention therefore seeks to provide a pack frame having adjustable means thereon for holding a cross member of a canoe and which also provides the required framework for a folding camp chair.

This invention greatly increases physical comfort of the person carrying a canoe. It allows an individual to walk farther over more difficult terrain without resting. It allows people of lesser strength, to carry a canoe where they would otherwise be unable to do so. It gives the person carrying the canoe better balance with less likelihood of falling, even allowing a free hand for a walking stick.

Accordingly the present invention provides an apparatus which functions as a combination backpack frame and canoe carrier and is convertible to a folding camp chair, said apparatus comprising first and second frame assemblies having upper ends, and ground engageable ends when used as a chair, each frame assembly including parallel side members, and transverse members, pivot means connecting the side members of the first and second frame assemblies, a web extending between upper ends of the frame assemblies to form a back rest and a seat portion, and straps extending between upper ends of the side members to maintain the frame members angularly disposed to each other to provide the chair function; and a carrier belt and shoulder straps on said frame assemblies for use in the carrier mode and means joining the upper portion of a first frame member with a ground engageable portion of the second frame member to support a cross member of an inverted canoe therebetween.

BRIEF DESCRIPTION OF THE DRAWINGS

In the accompanying drawings which show preferred embodiments of the invention.

Figure 1:
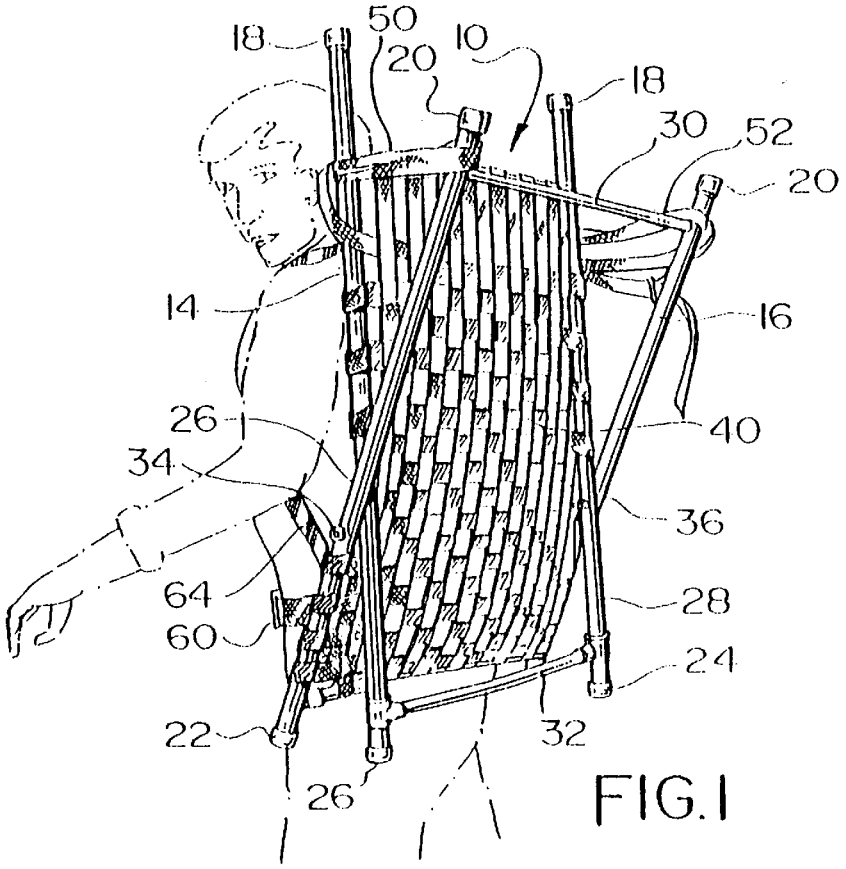
FIG. 1 is a perspective view of the combination canoe carrier and chair prior to use in the carrier function.
Figure 2:
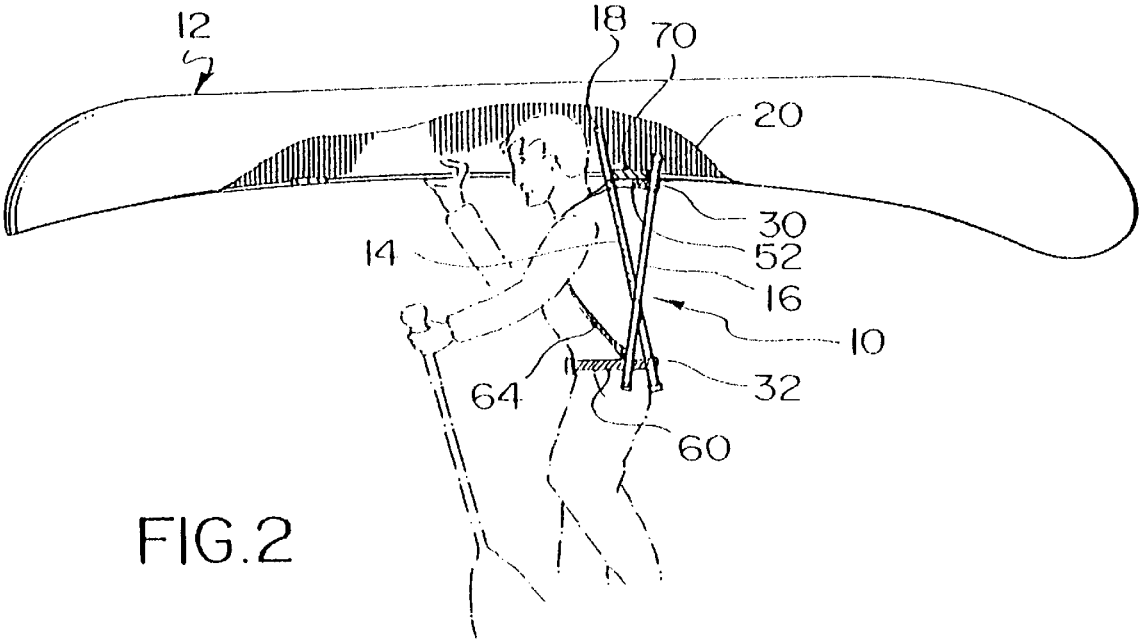
FIG. 2 is a diagrammatic view of the canoe carrier of this invention in position on a person carrying a canoe.

Referring now in detail to the drawings the combination canoe carrier and camp chair apparatus is shown generally at 10 in FIG. 1 and is shown supporting a canoe 12 in FIG. 2.

Figure 3:
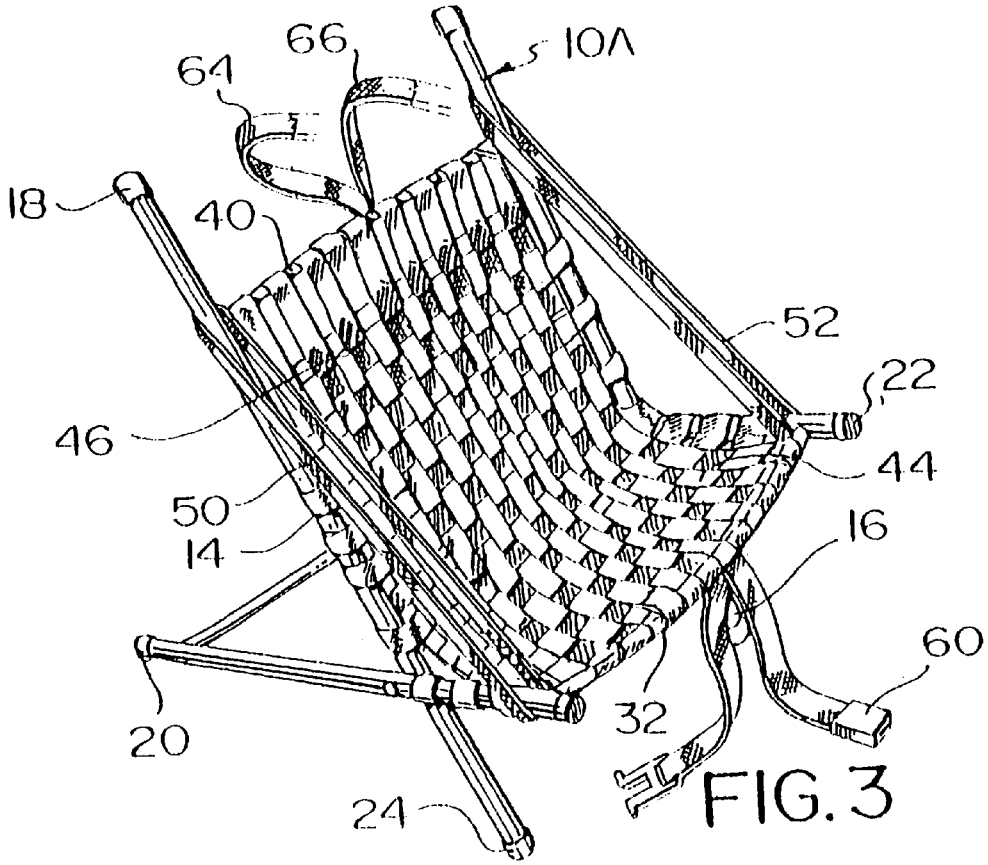
FIG. 3 is a perspective view of the carrier in the chair function.

The carrier 10 supports the inverted canoe 12 when used for carrying purposes and is capable of being used as a folding camp chair 10A as shown in FIG. 3.

The carrier comprises first and second rectangular frame assemblies 14 and 16, which have ends 18 and 20 respectively, and opposite ends 22 and 24 respectively.

Each of the frame assemblies has parallel side members 26 and 28 and transverse member 30 and 32. The frame assemblies are preferably constructed of light weight tubing welded or joined by mechanical "T" connectors.

The side members 26 and 28 of the first and second frame assemblies 14 and 16 are pivotally interconnected intermediate the ends as by bolts 34 and 36.

As shown in FIG. 3 a webbing 40 of suitable synthetic fabric is provided on the frames 14 and 16 to form a seat portion 44 and a back rest 46 on the chair 10A. It will be appreciated that a major portion of the webbing 40 will be against the wearer's back when the apparatus is used in the carrier mode.

The transverse member 32 which is preferably curved is at the wearer's waist so that a belt 60 secured thereto extends around and is secured to the wearer's waist.

Shoulder straps 64 and 66 are secured to the frame assemblies 14 and 16 in any convenient manner to hold the apparatus 10 on the wearer's back in a substantially vertical position. A web or plurality of straps 52 are adapted to extend between the ends 18 and 20 of the frames assemblies 14 and 16. The inverted canoe 12 as shown in FIG. 2 has a cross member or thwart 70 which is adapted to be supported on the straps 50 and 52.

In the chair mode the frame ends 20 and 24 of the frame assemblies 14 and 16 engage the ground. Transverse member 22 is the leading edge of the chair 10A. Straps 50 and 52 extend between the frames 14 and 16 to retain the frames in the chair mode.

Figure 4:
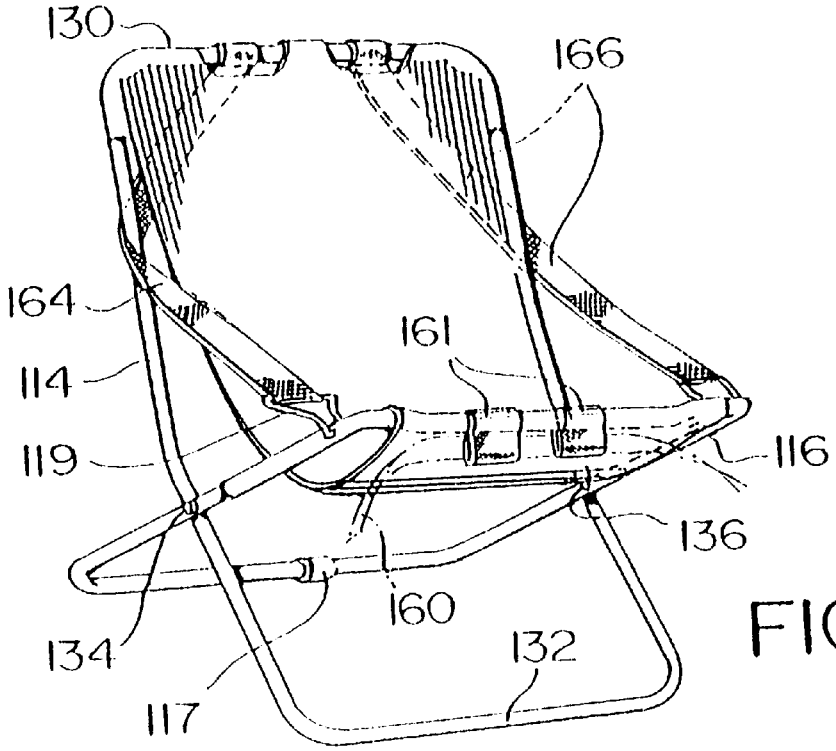
FIG. 4 is a perspective view of an alternative construction of the combination canoe carrier and chair.
Figure 5:
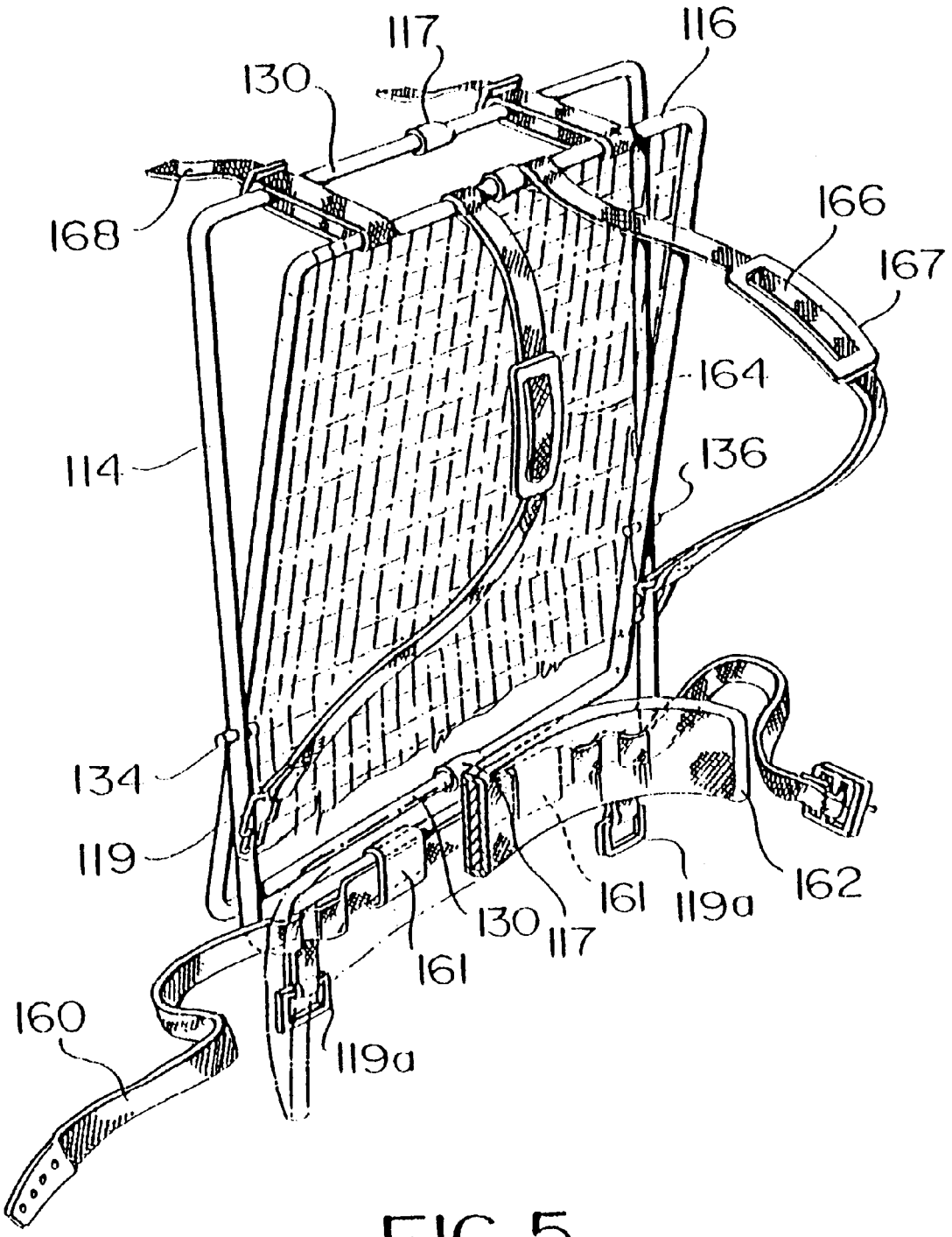
FIG. 5 is a perspective view of the frame of the carrier of FIG. 4.

Alternatively the canoe carrier and chair can be constructed of light weight tubing as shown in FIGS. 4 and 5. The rectangular frames 114 and 116 have ends butted and welded or flared to provide telescopic joints at 117. The frame members are pivot connected as by bolts 134 and 136. Transverse portions 130 and 132 of frames 114 and 116 are preferably contoured as described above. In the carrier mode a belt 160 extends around the wearer's waist and shoulder straps 164 and 166 are also provided. Each shoulder strap extends from frame 114 to frame 116 as described above. Suitable pads 167 are carried by the shoulder straps. A web formed of straps 168 is adapted to extend between ends of frame members 114 and 116 to support the canoe in the carrier mode described with reference to FIG. 2.

In the chair mode, straps 164 and 166 extend between frames 114 and 116 to provide the chair structure as shown in FIG. 4.

Straps 164 and 166 are fastened to the frames 114 and 116 by rings 119. Buckles (not shown) are also secured to straps 164 and 166 so that adjustments can be made.

Belt 160 is preferably equipped with a slip-on or snap-on pad 162 as shown in FIG. 5. In use in the canoe carrier mode, the belt, pad and shoulder straps are positioned or attached as necessary and the carrier 10 is ready to be secured to the wearer's back as shown in FIG. 1.

Figure 6:
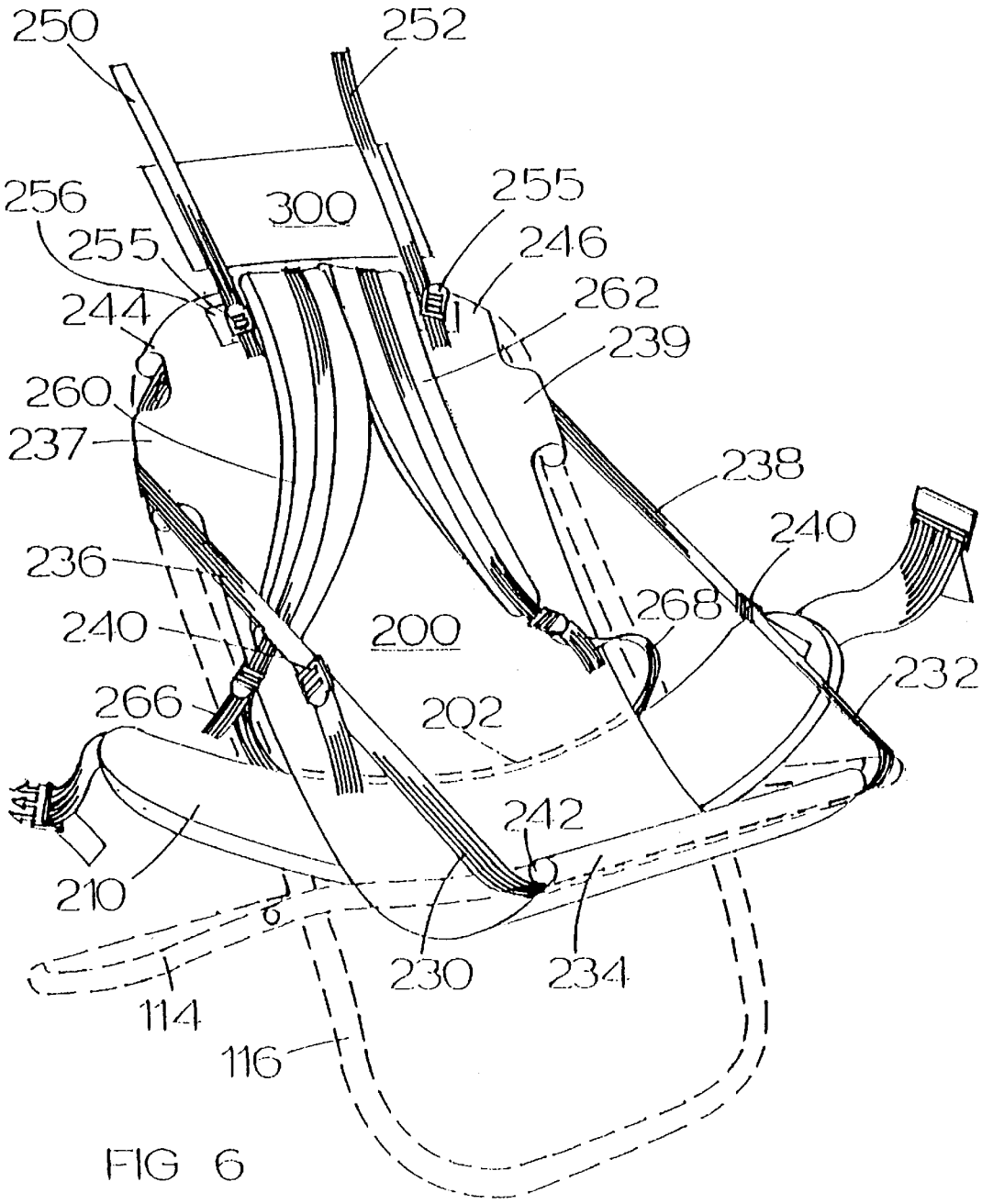
FIG. 6 is a perspective view of a fabric seat and back in the chair function.

As shown in FIG. 6, a combined chair and seat panel 200 of suitable fabric can be used in place of the seat 44 and back 46 shown in FIGS. 3 and 4. The panel 200 is used on the rectangular frames 114 and 116 in a manner similar to that shown in FIG. 4.

The panel 200 has a continuous loop 202 to receive and retain a padded belt 210. It will be appreciated that the loop 202 formed on the panel 200 connects the belt 210 to the frame 116, thereby replacing the separate loops 161, shown in FIG. 4. However, it may be desirable to provide adjustable straps similar to loops 161 as this will accommodate persons of varying heights such as for example short, medium or tall. Alternatively, the padded belt 210 is secured as by stitching, riveting, or the like directly to the panel 200.

The seat panel 200 has a pair of straps 230 and 232 adapted to be connected to straps 236 and 238 respectively by buckles 240 to hold the frames 114 and 116 in the chair position. The straps 230 and 232 are sewn to the underside of the panel 200 near a leading edge 234 of the panel 200 and the straps 236 and 238 are also sewn to the panel 200 adjacent an upper edge 246. A casing 242 at the leading edge 234 of the panel receives the tubular frame 114. A casing 244 at the upper or trailing edge 246 of the panel receives the frame 114. Loops 237 and 239 are formed on the back of the panel 200 to receive the frame 114.

A pair of spaced apart canoe support straps 250 and 252 are sewn to the adjacent upper edge 246 of the panel which has suitable reinforcements 256.

A web 300 extending between the straps 250 and 252 and sewn in a conventional manner provides the means for supporting the cross member of the inverted canoe when the carrier is in use as a canoe carrier. The straps connect the frames 114 and 116 in the same manner as the straps 168 shown in FIG. 5. The outer ends of the supports straps 250 and 252 are secured to buckles 255 provided on the panel 200.

Similarly, shoulder straps 260 and 262 are attached to the upper edge portion 246 of the panel 200 in any convenient manner such as sewing. Straps 266 and 268 secured to the belt 210 are adapted to be adjustably connected to the shoulder straps 260 and 262 respectively.

In use, if the carrier 10 shown in FIGS. 1, 2, and 3 has been used as a chair 10A, straps 68 are detached from the leading edge of the chair seat and the free ends are secured to the ground engaging end 20 of frame 16 thereby interconnecting frames 14 and 16 to provide the web means for supporting a thwart 70 of the canoe 12 as shown in FIG. 2.

Use of the carrier shown in FIG. 5 is similar to that of the carrier of FIG. 2. The pad 162 is positioned on the belt 160 through loops 161, the shoulder straps 164 and 166 are slipped over the shoulders of the wearer and the belt 160 is secured about the wearer's waist. The canoe 12 is then loaded on the carrier 10 preferably with the help of a second person, so that the thwart 70 of the canoe 12 engages the straps 168 of the carrier 10.

The seat and back rest formed by the panel 200 of FIG. 6 is provided with frames 114 and 116 and is used in a manner similar to the chairs 10A described with reference to FIGS. 3, 4 and 5.

The straps 230 and 232 are secured to the straps 236 and to hold the frames 114 and 116 in the chair position as shown in dashed lines in FIG. 6. It will be understood that when the panel 200 is in the carrier mode (not shown) the belt 210 will be around the person's waist, the shoulder straps 260 and 262 will be connected to the straps 266 and 268 and the straps 250 and 252 will connect the frame members 114 and 116 so that the web 300 will be in position to support the thwart 70 of the canoe 12.

I claim:

1. An apparatus which functions as a combination backpack frame and canoe carrier and is usable as a folding camp chair, said apparatus comprising:

first and second frame assemblies having upper ends, and ground engageable ends in the chair mode, each frame assembly including a tubular member bent to form a rectangle having parallel side members;

pivot means connecting the side members of the first and second frame assemblies intermediate their ends to define upper and lower portions for each frame assembly; a first transverse member interconnecting said upper portion of said side members of said first frame assembly, a second transverse member interconnecting an upper portion of said side members of the second frame assembly and a third transverse member interconnecting the lower portion of the parallel side members of said second frame assembly;

a web extending between upper portions of the frame assemblies to form a back rest and a seat portion;

straps to extend between upper portions of the side members of each frame assembly to maintain the first and second frame assemblies angularly disposed to each other to form the chair; and a carrier belt secured to said seat portion adjacent said second frame and extending along said second transverse member and shoulder straps secured between the upper portions of the first and second frame assemblies for use in a carrier mode and means joining the upper portion of a first frame assembly with the lower portion of the second frame assembly while in the carrier mode to support a cross member of an inverted canoe therebetween.

2. A canoe carrier as claimed in claim 1, wherein said second transverse member of said second frame assembly associated with said belt, is contoured to fit the wearer.

3. A canoe carrier as claimed in claim 1, wherein a first telescoping joint is formed by said tubular member on the second transverse member of said first frame assembly; and a second telescoping joint is formed by said tubular member on the third transverse member of said second frame assembly.

* * * * *